United States Patent [19]

Bitting

[11] Patent Number: 4,857,823

[45] Date of Patent: Aug. 15, 1989

[54] BANDGAP VOLTAGE REFERENCE INCLUDING A PROCESS AND TEMPERATURE INSENSITIVE START-UP CIRCUIT AND POWER-DOWN CAPABILITY

[75] Inventor: Ricky F. Bitting, Fort Collins, Colo.

[73] Assignee: NCR Corporation, Dayton, Ohio

[21] Appl. No.: 248,218

[22] Filed: Sep. 22, 1988

[51] Int. Cl.[4] ..... G05F 3/16

[52] U.S. Cl. ..... 323/314; 323/901

[58] Field of Search ..... 323/312, 313, 314, 315, 323/316, 901, 907

[56] References Cited

U.S. PATENT DOCUMENTS

| | | | |
|---|---|---|---|
| 3,648,154 | 3/1972 | Frederiksen et al. | 323/313 |
| 3,886,435 | 5/1975 | Steckler | 323/901 |
| 4,085,359 | 4/1978 | Ahmed | 323/314 |
| 4,419,594 | 12/1983 | Gemmell et al. | 323/315 |
| 4,588,941 | 5/1986 | Kerth et al. | 323/907 |
| 4,618,816 | 10/1986 | Monticelli | 323/316 |

OTHER PUBLICATIONS

Michejda et al., "A Precision CMOS Bandgap Reference", *IEEE Journal of Solid State Circuits,* Dec. 1984, pp. 1014–1021.

Song et al., "A Precision Curvature-Compensated CMOS Bandgap Reference", *IEEE Journal of Solid State Circuits,* Dec. 1983, pp. 634–643.

*Primary Examiner*—Peter S. Wong

*Attorney, Agent, or Firm*—Wilbert Hawk, Jr.; Casimer K. Salys

[57] ABSTRACT

A bandgap voltage reference start-up circuit configured to initiate bandgap reference operation over an extended temperature range while being relatively insensitive to the effects of fabrication process variables. The circuit as preferably implemented includes a differential amplifier in the bandgap voltage reference stage which controls the source of current to contrasted bipolar devices situated in parallel paths. A comparator monitors the activities of the current source drive signal and compares that to an internally generated reference, which reference is configured to the matched in temperature and process variable effect the corresponding bandgap reference bipolar device and the current source device. During start-up the comparator initiates an injection of current into one bipolar device of the bandgap reference circuit to drive the bandgap loop into the appropriate of two potential operating states. The preferred embodiment also includes a power-down mode capability.

9 Claims, 3 Drawing Sheets

BANDGAP VOLTAGE REFERENCE INCLUDING A PROCESS AND TEMPERATURE INSENSITIVE START-UP CIRCUIT AND POWER-DOWN CAPABILITY

BACKGROUND OF THE INVENTION

The present invention relates to an electronic circuit for generating a stable reference voltage. More particularly, the invention involves a refined bandgap type reference circuit which incorporates a temperature and process variable insensitive start-up circuit and has the capability to operate in a power-down mode.

Bandgap type reference voltage generating circuits have recently become popular for providing precise reference voltages on integrated circuit devices. The article entitled "A Precision Curvature-Compensated CMOS Bandgap Reference" by Song et al. which appeared in the *IEEE Journal of Solid-State Circuits,* December 1983, pp. 634–643, and the article entitled "A Precision CMOS Bandgap Reference" by Michejda et al. which appeared in the *IEEE Journal of Solid State Circuits,* December 1984, pp. 1014–1021, are examples of the relatively recent analyses and design efforts expended to develop bandgap reference circuits which are stable over extended temperature ranges. A further variation of related work is set forth in U.S. Pat. No. 4,588,941. The focus of these developments was to eliminate bandgap reference voltage variations attributable directly to temperature. Neither start-up problems nor power-down capabilities were meaningfully addressed in the references.

Start-up circuits per se are known. For example, U.S. Pat. No. 3,648,154 discloses a circuit for starting a diode string reference used in conjunction with a bipolar differential amplifier circuit. A simple bandgap start-up circuit does appear in U.S. Pat. No. 4,618,816, but as configured remains as an active element affecting the reference regulation loop after start-up. The general concept of powering down a reference circuit is described in U.S. Pat. No. 4,419,594, wherein the power-down transistors are selectively located in the circuit to disable the reference circuit.

In the presence of such teaching, there remains the need for a bandgap voltage reference generating circuit which provides a stable output voltage with temperature, includes a temperature insensitive start-up capability, completely decouples the start-up circuit effects during steady-state reference voltage generation, and incorporates an effective power-down capability. Foremost, these objectives must be met in a commercial environment where daily process variations do not materially degrade operability of the circuit. It is combinations of these features that the present invention addresses.

SUMMARY OF THE INVENTION

The present invention involves a bandgap type reference voltage generating circuit with accentuated start-up reliability and effectiveness. The circuit ensures that the bipolar transistors which provide the bandgap reference receive an adequate injection of start-up current to become enabled and then stabilize at the appropriate of two potential operating states. The need for start-up current injection is detected by circuitry configured to be relatively insensitive to fabrication process variations. The start-up circuit as further refined includes a comparator circuit which operates at a voltage level below that of the composite bandgap reference circuit. The comparator is thereby active at an early stage of any power-up cycle. As a further feature, the circuit incorporates a multiplicity of field effect transistor actuated switches to selectively disable all circuit elements drawing material power upon the presence of a power-down signal.

Structurally, the circuit includes a pair of bipolar transistors configured along parallel paths containing resistive elements and sharing current from a single regulated source. The pseudo-current source is controlled by a differential amplifier which responds to the relative levels of current in the two paths. Fixed differences in the magnitudes of the two currents are attributable to dimensional differences in the two bipolar transistor emitter electrode areas.

A comparator in the start-up circuit contrasts the start-up conditions as represented by the output of the differential amplifier with a reference voltage state generated in a mirrored arrangement of bipolar device with series load. Failure of the bandgap reference circuit to attain the appropriate conductive state is detected by the comparator, which detection initiates a temporary injection of current through a transistor connected to one of the parallel paths to force the bandgap reference circuit into the conductive operating state. Matching of the bipolar and field effect transistor device structures by dimension and physical proximity on the integrated circuit ensures operability in the face of process variables. The matching inherently reduces temperature effects as may influence the operability of the start-up circuit.

These and other features of the invention will be more clearly understood and appreciated upon considering the detailed description which follows.

DESCRIPTION OF THE PREFERRED EMBODIMENT

Figure 1:
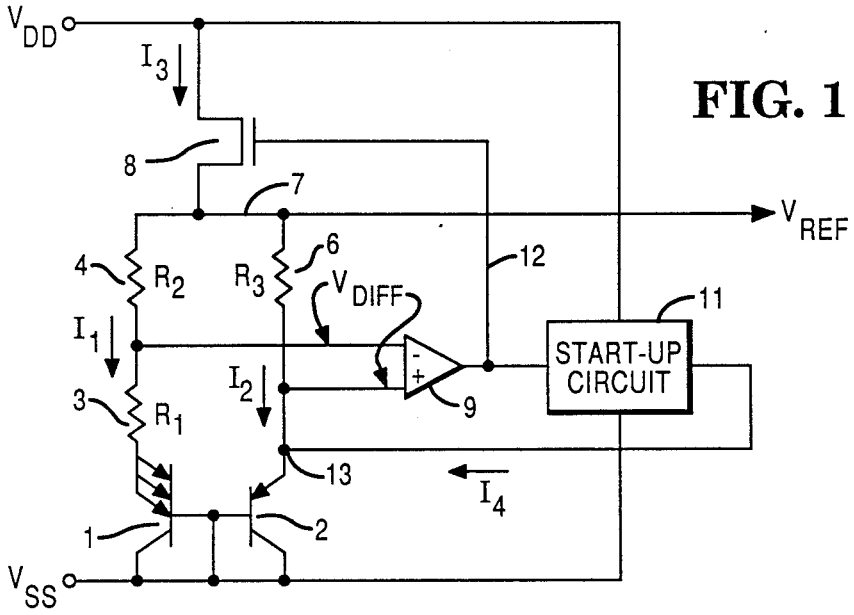
FIG. 1 is a schematic illustrating the functional arrangement of the start-up circuit for the bandgap reference.

FIG. 1 depicts a composite of structure elements and functional representations which embody the present bandgap voltage reference invention. As shown, a pair of bipolar transistors 1 and 2 are connected in respective series paths with resistors 3 and 4 for transistor 1 and resistor 6 for transistor 2 to conduct corresponding currents $I_1$ and $I_2$. The voltage at node 7, identified as $V_{ref}$, is controlled by field effect transistor 8, conducting current $I_3$, in response to the closed loop regulation signals generated by differential amplifier 9. As is common practice in bandgap reference circuits, bipolar transistors 1 and 2 differ primarily in the areas of their emitter junctions. The area of the transistor 1 is defined to be measurably greater, nominally by a factor of 8, than the junction area of transistor 2. Differential amplifier 9 of the circuit in FIG. 1 is high in gain, and for purposes of illustration and correspondence to actual integrated circuit devices is presumed to have an offset voltage of a nominal 32 millivolts. Offset voltages less then 10 millivolts are typical for integrated circuits fabricated under advanced design rules of 2 micrometers or less. For the nominal 32 millivolt conditions it can be written that:

$$I_1 = I_2 = dV_{BE}/R_1,$$

where $$dV_{BE} = (Kt)\ \ln(A_1/A_2) = 53.9 \text{ millivolts at } 23^\circ \text{ C.}$$

$A_1/A_2$ is the ratio of emitter-to-base junction areas of transistors 1 and 2. $V_{DIFF}$ is the differential voltage between the inverting and non-inverting inputs of amplifier 9. $I_3$ is the composite of currents $I_1$ and $I_2$ as flows through n-channel control transistor 8.

Differential amplifier 9, field effect transistor 8, bipolar transistors 1 and 2, and resistors $R_1$, $R_2$ and $R_3$ together create a bandgap reference circuit having a feedback loop with two stable operating points. The desired operating point is at the aforementioned $I_1 = I_2 = dV_{BE}/R_1$. The second and undesired stable operating point exist under the condition where $I_1 = I_2 = 0$. The purpose of the start-up circuit 11 in FIG. 1 is to ensure that the bandgap loop does not stabilize at the $I_1 = I_2 = 0$ operating state, but rather, consistently and without regard to temperature or fabrication process variable effects transitions upon being powered to the desired bandgap voltage reference level of $I_1 = I_2 = dV_{BE}/R_1$.

To appreciate the implications of this objective, it should be recognized that when $V_{DD}$ rises during power-up $I_1$ and $I_2$ are zero for $V_{DD}$ values less than a nominal two volts. Namely, the undesired operating state is the first encountered by the bandgap reference circuit. If the input offset voltage of differential amplifier 9 is either negative or of such a value that the output from amplifier 9 on node 12 is below the threshold voltage of transistor 8 for the $V_{DIFF} = 0$ condition, the operating state of the bandgap circuit will remain at the undesired level of $I_1 = I_2 = 0$ even upon reaching the full voltage of $V_{DD}$. The present invention recognizes that with extended operating temperature ranges and fabrication process variations, the likelihood of encountering such conditions is increased with potentially disastrous effects on the operability of the integrated circuit product.

Figure 2:
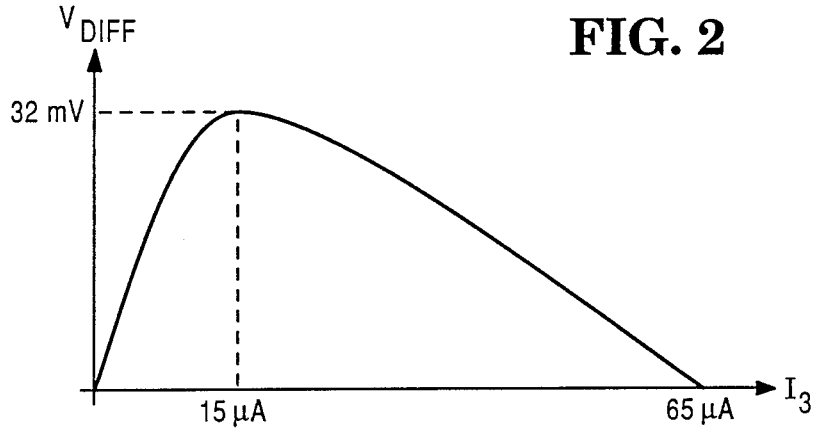
FIG. 2 illustrates by voltage-current plot the two states possible following start-up.

To eliminate the likelihood that such a problem will ever be realized, the present invention in FIG. 1 incorporates start-up circuit 11 to inject into node 13 a temporary current $I_4$ in an amount suitable to consistently shift node 13 above the maximum possible negative input offset voltage of amplifier 9. The effect of such injection is to drive the bandgap reference loop to the desired stable operating point. For example, in the context of the parameters depicted in FIG. 2, a temporary current $I_4$ of 30 microamps would, when injected into the emitter-base junction of transistor 2, create a voltage on node 13 materially greater than the maximum negative input offset voltage of 32 millivolts.

Unfortunately, the provision of a suitable current $I_4$ is affected by the operating temperature during start-up and fabrication process variable influences on transistor 2, differential amplifier 9, and transistor 8, with secondary effects contributed by the other elements of the bandgap reference circuit in FIG. 1. To ensure the reliable start-up operation of the circuit in the face of such variables, the present start-up circuit includes both a reference circuit and a comparator circuit. The reference circuit is designed to provide a relatively mirrored structure and similarity of operation by virtue of proximity on the integrated circuit device. The comparator function ensures continuity of the injected start-up current until the bandgap reference loop approaches the correct operating state. The actual time constant of the start-up circuit is primarily determined by the frequency compensation characteristics of the differential amplifier 9.

Figure 3:
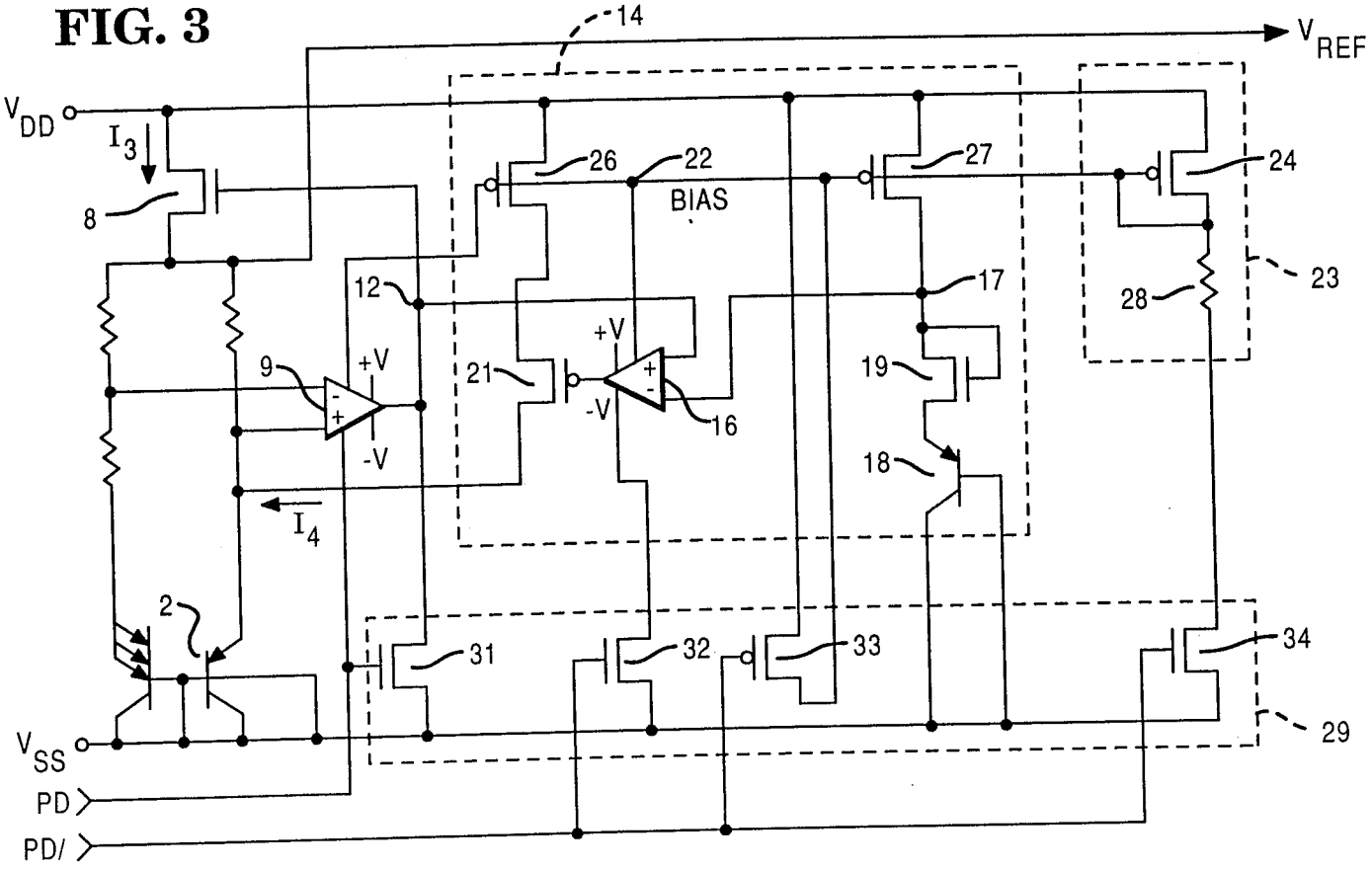
FIG. 3 is a schematic depicting by circuit the features of the present invention.

The objectives noted above are attained using the particular circuit embodied in FIG. 3 of the drawings. The start-up circuit enclosed within dashed block 14 is responsive to comparator 16. As a first input, comparator 16 receives the voltage on node 12 common to the gate electrode of pseudo-current source configured transistor 8. The complementary input to comparator 16 is derived from node 17, which node potential reflects the temperature and process variable characteristics of mirrored bipolar transistor 18 and structurally similar field effect transistor 19. The similarities ensure operational correspondence between the characteristics of transistor 18 as matched to those of transistor 2 and the characteristics of transistor 19 as distinctly offset from those of transistor 8. Transistor 19 is designed to conduct approximately one-fourth the current of transistor 8.

Consistency of structure relationships is obtained in part by locating transistors 2 and 18 in close proximity on the integrated circuit device, and by dimensionally matching the patterns thereof. A similar approach is used in constraining the characteristics of transistors 8 and 19, which as noted above differ in that the gate width of field effect transistor 8 is approximately four times that of transistor 19. As a consequence, the voltage on node 17 consistently exceeds the voltage on node 12 during the start-up phase of operation.

Start-up current $I_4$ is furnished through p-channel transistor 21 in response to a low voltage level output from comparator 16. Comparator 16 continues to cause start-up current injection until differential amplifier 9 raises node 12, enabling transistor 8 to conduct current $I_3$ and a transition to the appropriate stable operating state of the bandgap reference circuit. The consistent operation and success of the start-up circuit in block 14 is ensured through the use of mirrored devices for reference and feedback detection of the state within the bandgap loop.

Node 22 provides a bias voltage the magnitude of which is defined by the bias circuit within block 23 as dominated by the current conduction characteristics of p-channel transistor 24. The bias voltage on node 22 also enables p-channel transistors 26 and 27, which respectively furnished start-up current $I_4$ and the start-up reference current conducted through reference transistors 18 and 19. For an embodiment in which the $V_{DD}$ is normally 5 volts and $V_{SS}$ is at ground potential, bias resistor 28 is in the range of 75K ohms. This arrangement provides a current of approximately 50 microamps through resistor 28. Under such bias conditions, and for the preferred arrangement within start-up circuit 14, transistor 27 conducts a nominal 12.5 microamps upon reaching its steady state condition.

The preferred embodiment depicted in FIG. 3 incorporates a further beneficial feature, generally referred to as a power-down mode capability. During such power-down mode of operation, the circuit draws negligible current notwithstanding the presence of the full supply voltage $V_{DD}$. The mode is initiated by the concurrent transition of the voltage on line PD to a high level as the voltage on complementary line PD/transitions to a low level. The effect of the power-down mode are introduced into the circuit by the functional elements within block 29.

Figure 4:
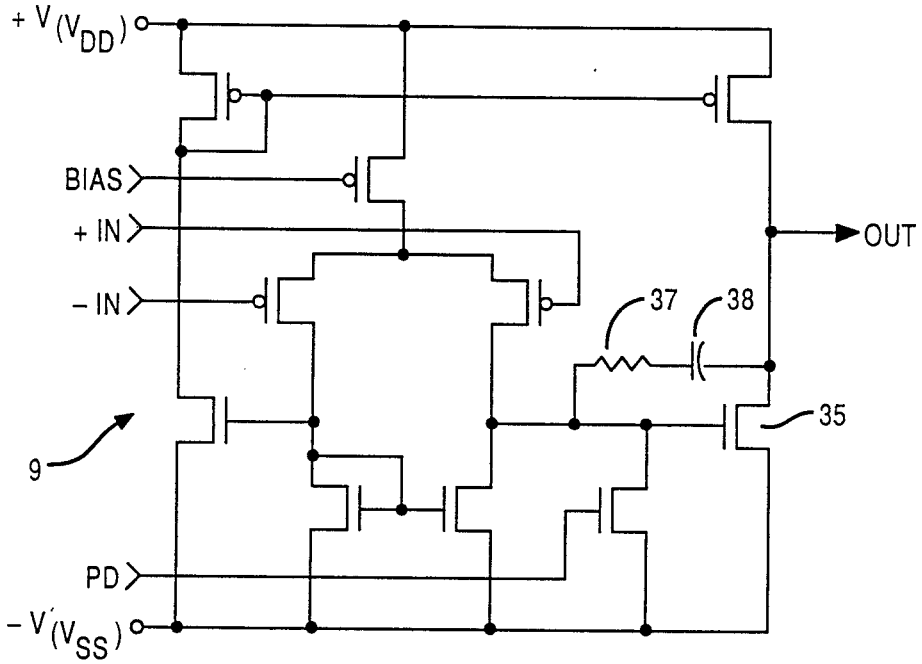
FIG. 4 is a schematic illustrating the differential amplifier circuit.

A high level signal on line PD enables transistor 31, bringing node 12 to $V_{SS}$ and thereby zeroing bandgap reference current $I_3$. The effects of a high voltage level on line PD are also conveyed to differential amplifier 9, where, as shown in FIG. 4, pull-down transistor 35 of the complementary output driver pair is disabled.

The low level signal on line PD/ in FIG. 3 affects transistors 32, 33 and 34 within power-down block 29. Such low voltage on line PD/ enables p-channel transistor 33, pulling bias node 22 to the voltage $V_{DD}$. This assures that all current source transistors responsive to the bias voltage on node 22 are disabled. Concurrently, transistor 34 is disabled to cut off the flow of any current through the path including resistor 28. Pulling bias node 22 to $V_{DD}$ also disables comparator 16, as is discernible from the detailed circuit in FIG. 5. The low level signal on PD/ eliminates current flow through comparator 16 by disabling transistor 32, which transistor connects the negative line $-V$ of comparator 16 to $V_{SS}$. As a consequence of such signals on lines PD and PD/ the bandgap voltage reference circuit depicted in FIG. 3 draws substantially no power when operated in the power-down mode.

An important benefit of the bandgap voltage reference start-up circuit depicted in FIG. 3 is the elimination of the effects of otherwise critical temperature sensitive and process variable sensitive parameters in differential amplifier 9 and comparator 16. Though one would prefer that the negative input offset voltage amplifier 19 be low and stable with the temperature, the broad operating range of start-up circuit ensures that the bandgap reference is not operative based upon such single set of critical parameters.

Figure 5:
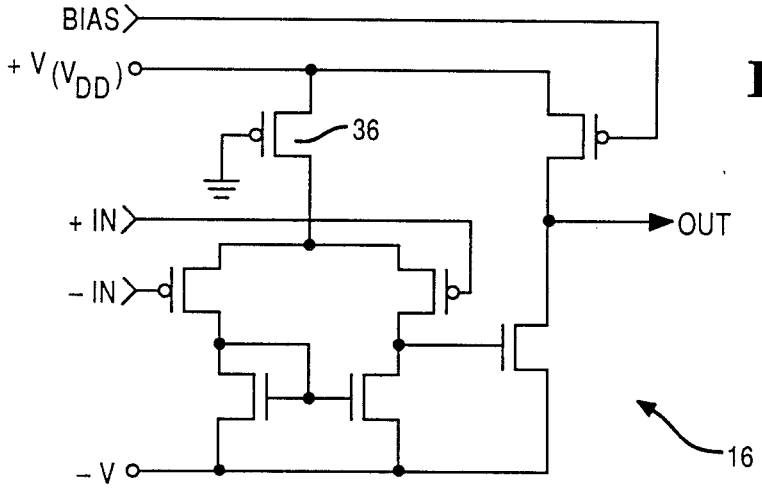
FIG. 5 is a schematic illustrating the comparator circuit.

Preferably, comparator 16 as embodied in FIG. 5 exhibits the capability to operate at relatively low input and supply voltages. Such capability facilitates early comparator operation during the power-up of the supply voltage $V_{DD}$. In this regard, p-channel transistor 36 of comparator 16 in FIG. 5 is preferably a long channel resistor-like device rather than the more conventional current source.

Differential amplifier 9 as schematically depicted in FIG. 4 incorporates an RC feedback path around pull down transistor 35. The path is composed of resistor 37, approximately 1,000 ohms in value, and capacitor 38, having a nominal value of 10 picofarads. This RC circuit reduces the amplifier's slew rate sufficiently to ensure that the bandgap reference loop is stable. Clearly, the particulars of the differential amplifier design, as well as the stabilization circuit, would be refined to suit the particular objectives of the user through an application of known engineering techniques.

The structure and operational characteristics of the present bandgap voltage reference start-up circuit ensures that the reference voltage generation elements will consistently reach the appropriate operating state, notwithstanding operating temperature extremes, e.g. a military temperature ranging from −55° C. to 125° C., and the fabrication process variation induced effects on the operational characteristics of the numerous active and passive components which interact during the dynamics of the start-up transient. As an additional feature, the preferred embodiment includes an effective and efficient power-down mode capability, which when enabled effectively reduces current flow to the nanoamp range even at the upper range of the temperature extreme.

It will be understood by those skilled in the art that the embodiments set forth hereinbefore are merely exemplary of the numerous arrangements by which the invention may be practiced, and as such, may be replaced by equivalents without departing from the invention which will now be defined by appended claims.

I claim:

1. A bandgap reference circuit with reliable start-up comprising:

a first path for current flow having a first bipolar transistor connected in electrical series with a first resistive element;

a second path for current flow having a second bipolar transistor, of materially different emitter electrode area than the first transistor, connected in electrical series with a second resistive element;

a node defined by the common connection of the base electrodes of the first and second bipolar transistors and a bipolar transistor collector electrode;

means for detecting differences in the magnitudes of the currents flowing in the first and second paths, and providing an output signal proportional thereto;

means for regulating the current flow through the first and second paths responsive to the output signals from the means for detecting;

a third path for current flow having a third bipolar transistor, of similar emitter electrode area to that of the first bipolar transistor, connected in electrical series with a load element;

means for detecting a current flow in the third path, for detecting the enablement state of the means for regulating, and for injecting current into the first path bipolar transistor upon coincidence of a current flow in the third path and a disabled state in the means for regulating.

2. The apparatus recited in claim 1, wherein the means for detecting a current flow in the third path is a comparator.

3. The apparatus recited in claim 2, wherein the means for detecting differences in the magnitudes of the currents flowing in the first and second paths is a differential amplifier, and the means for regulating the current flow comprises a transistor.

4. The apparatus recited in claim 2, wherein the load element in the third path has temperature sensitive parameters similar to the means for regulating the current flow but structured to be materially different in load value.

5. The apparatus recited in claim 1, wherein a power-down signal disables the means for regulating, the means for detecting current flow in the third path, and the means for detecting differences in the magnitudes of the currents flowing.

6. The apparatus recited in claim 4, wherein a power-down signal disables the means for regulating, the means for detecting current flow in the third path, and the means for detecting differences in the magnitudes of the currents flowing.

7. The apparatus recited in claim 5, wherein the power-down signal is used to control multiple field effect transistors which disconnect the respective means from a power supply.

8. The apparatus recited in claim 1, wherein the means for detecting a current flow in the third path is operational at a power supply voltage level materially lower than the nominal operating voltage range of the bandgap reference circuit power supply.

9. The apparatus recited in claim 6, wherein the comparator is operational at a power supply voltage level materially lower than the nominal operating voltage range of the bandgap reference circuit power supply.

* * * * *